US005776303A

United States Patent [19]

Stahlecker

[11] Patent Number: 5,776,303

[45] Date of Patent: Jul. 7, 1998

[54] COVERING FOR AN OPENING IN A FLEXIBLY CURVING CONTAINER WALL

[75] Inventor: Werner Stahlecker, Stuttgart, Germany

[73] Assignee: Ruediger Haaga GmbH, Germany

[21] Appl. No.: 595,800

[22] Filed: Feb. 2, 1996

[30] Foreign Application Priority Data

Feb. 3, 1995 [DE] Germany ..... 195 03 458.9

[51] Int. Cl.[6] ..... B65B 7/28

[52] U.S. Cl. ..... 156/583.1; 53/329; 53/485; 156/69

[58] Field of Search ..... 156/583.3, 583.1, 156/567, 308.4, 69; 53/471, 478, 485, 486, 329, 329.2

[56] References Cited

U.S. PATENT DOCUMENTS

| | | | |
|---|---|---|---|
| 2,898,003 | 8/1959 | Wilson | 156/69 |
| 3,449,183 | 6/1969 | Zelnick | 53/478 |
| 3,491,509 | 1/1970 | Wright | 53/478 |
| 3,706,175 | 12/1972 | Anderson | 53/485 |
| 4,397,401 | 8/1983 | Ueno | 53/477 |
| 5,230,205 | 7/1993 | Hautemont | 53/485 |
| 5,597,428 | 1/1997 | Matsumoto | 53/485 |

FOREIGN PATENT DOCUMENTS 40 31 472 A1 of 0000 Germany .

*Primary Examiner*—Daniel Stemmer
*Attorney, Agent, or Firm*—Evenson, McKeown, Edwards & Lenahan, P.L.L.C.

[57] ABSTRACT

An opening of a flexible container is closed by a pull-tab. The wall curves when the pull-tab is applied thereto. The pull-tab follows the curving wall in the curve direction. A device for applying the pull-tab to the wall and/or a device for adhering the pull-tab to the wall are so constructed that they adapt to the changing form of the curving wall.

1 Claim, 6 Drawing Sheets

Fig.3a
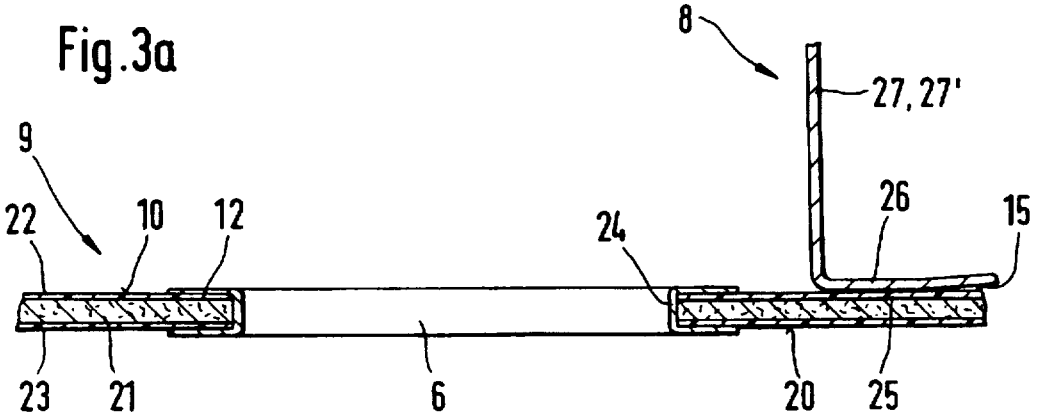
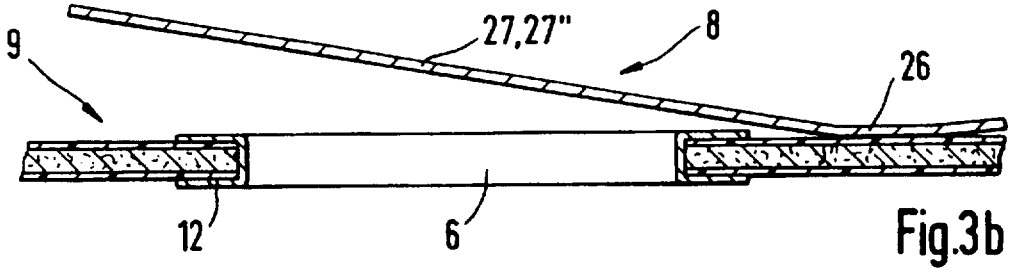
Fig.3b
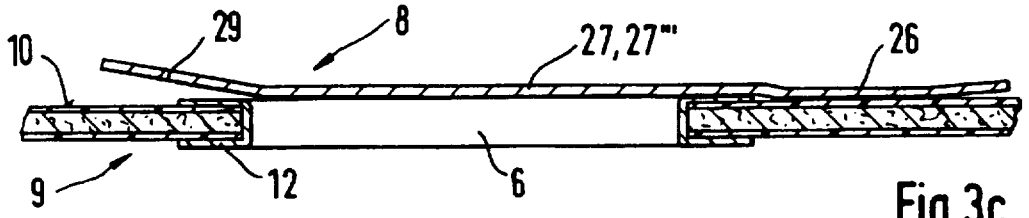
Fig.3c
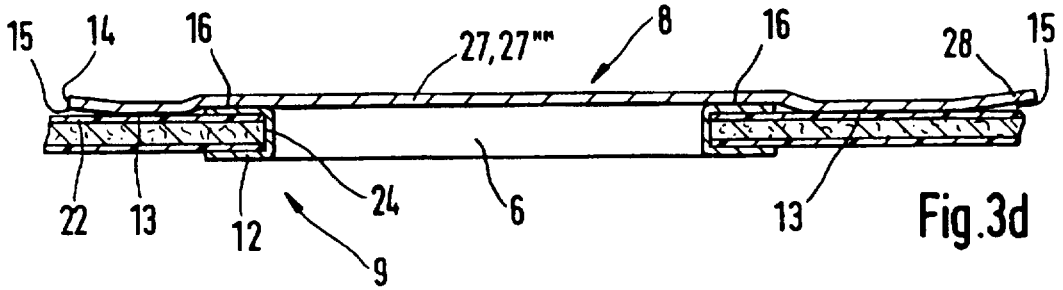
Fig.3d

COVERING FOR AN OPENING IN A FLEXIBLY CURVING CONTAINER WALL

BACKGROUND AND SUMMARY OF THE INVENTION

The present invention relates to a process for manufacturing a covering for an opening in a flexibly curving container wall, in which a pull-tab is laid over the opening and over an area bordering the wall, the pull-tab being adhered to the surface of the wall so that the opening is sealed along its perimeter.

The present invention relates further to an apparatus for manufacturing the covering, comprising a pull-tab for an opening in a flexibly curving container wall. The apparatus comprises a device for applying the pull-tab to the surface of the wall over and beyond the opening, and a device for adhering the pull-tab to the surface of the wall.

The present invention relates further to the covering for an opening in a flexibly curving container wall with a pull-tab which covers the opening and the area bordering the wall, the pull-tab being adhered to the surface of the wall in peripheral direction of the opening by a continuous sealing seam.

German published patent application 40 31 472 describes a container where a pull-tab, applied before filling, seals closed an opening of a container after filling. The pull-tab is hereby first adhered to a place on the container wall beside the opening. This localized adhesion is effected such that the opening remains uncovered for the purpose of subsequent filling. After filling, the pull-tab is laid over the opening and adhered to the surface of the container wall bordering thereto. Depending on the type of material used, the wall tends to curve when the pull-tab is applied. This can lead to problems when covering the opening.

It is an object of the present invention to exactly cover with a pull-tab an opening set in a flexibly curving wall.

The foregoing object has been achieved in accordance with the present invention that the pull-tab follows the curve of the wall. In the apparatus of the present invention, the object is further achieved in that the application device and/or the adhering device can follow the curve direction. In the covering of the present invention, the object has been achieved in that a section, bordering the periphery of the pull-tab in the direction of the opening, and/or a section, comprising a protective covering for the edge of the opening are excluded from the course of the sealing seam.

The present invention has the advantage of enabling a secure and exact closing of an opening by a pull-tab on the wall of a container. The present invention can be used for all container walls made of a flexible material where a pull-tab is applied. The pull-tab can be applied to a wall of a completed container or to a wall from which a container is to be made. Also the container can comprise one wall or a plurality of walls together; and the configuration of the container is not of importance.

The present invention is especially suited to containers where the wall, to which the pull-tab is applied, is made of cardboard. Other materials, however, for example plastics, which curve when the pull-tab is applied, can also be used.

In the apparatus according to the present invention, the devices for applying the pull-tab and/or adhering same to the wall, are placed on the pull-tab. The devices follow the curving movement of the wall which is caused by the application of the pull-tab, which is why they remain constantly in a fixed position on the pull-tab while they carry out their respective procedural steps. The pull-tab adapts to the changed shape of the wall caused by curving.

It is particularly advantageous when the application device and/or the adhering device comprises an application surface which can be pressed against the wall, and whose outer contour is adapted to the contour of the flexible wall. The application surface rests over a large surface area against the pull-tab. The pull-tab adapts to the form of the curved wall caused by the pressure from the application surface, and covers, as a result of the outer shape of the application surface, a large surface area of the wall.

It is further advantageous when the application surface of the application device is formed by the peripheral surface of a spherical roller, which can be guided over the pull-tab with a direction component which extends along the surface of the wall. This results in a close application of the pull-tab onto the surface of the wall, so that good conditions for a later adhering of the pull-tab are created. It is not necessary here for the spherical roller to be guided over the entire length of the pull-tab.

In an advantageous embodiment, the application surface of the adhering device is curved convexly. This convex curve corresponds advantageously to the concave curve of the wall, which arises when the application device and/or the adhering device are pressed against the wall.

In a further advantageous embodiment, the application surface of the adhering device can be heated for the purpose of heat sealing, and is formed with a smaller surface area than the pull-tab. These measures reduce the requirements for an exact guiding of the adhering device. Even if the adhering device should be deflected when being guided to the curving wall, it will still not reach beyond the pull-tab and into the area of the wall surface. Thus the danger of the surface of the wall being damaged due to the high temperatures of the adhering device is avoided.

It is especially advantageous when the application surface of the adhering device comprises a recess which corresponds to the line of a protective covering surrounding the edge of the opening. Due to these measures, the danger of the protective covering adhering to the pull-tab is avoided. Such an adhesion could lead to possible later damage of the protective covering when the pull-tab is removed.

BRIEF DESCRIPTION OF THE DRAWINGS

These and further objects, features and advantages of the present invention will become more readily apparent from the following detailed description thereof when taken in conjunction with the accompanying drawings wherein:

FIGS. 3*a* to 3*d* are cross-sectional views showing various procedural stages during application of a pull-tab to the front wall of the container shown in FIGS. 1 and 2;

DETAILED DESCRIPTION OF THE DRAWINGS

Figure 1:
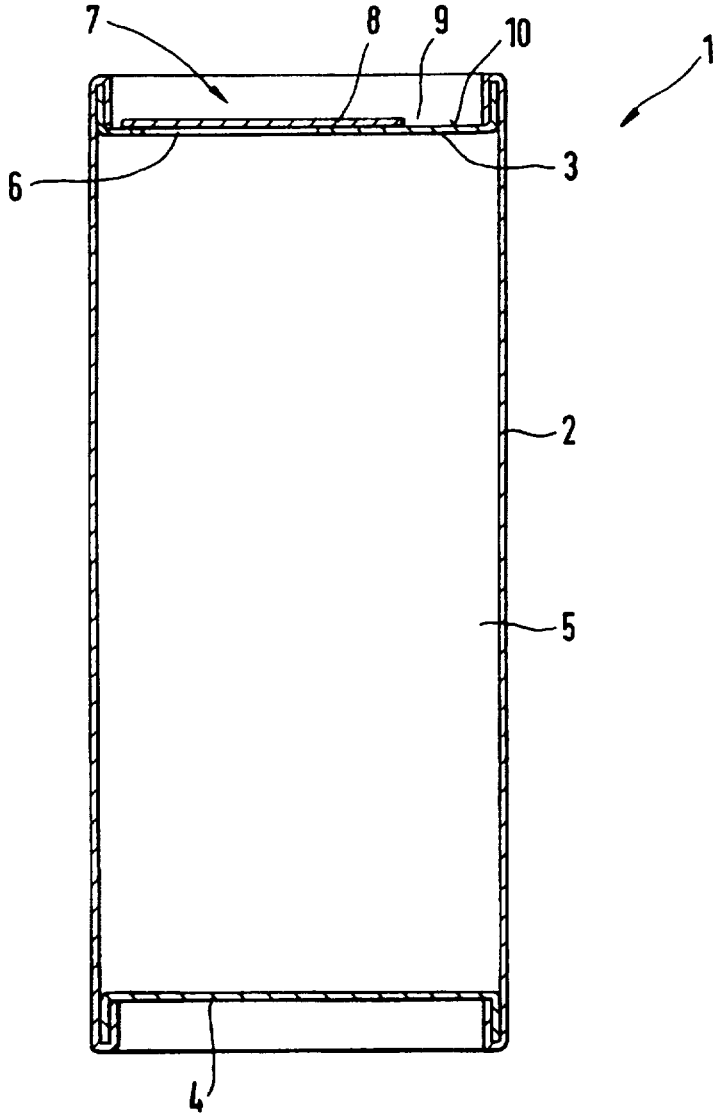
FIG. 1 is an elevational, cross-sectional view of a cylindrical container with a pull-tab applied to one front wall.
Figure 2:
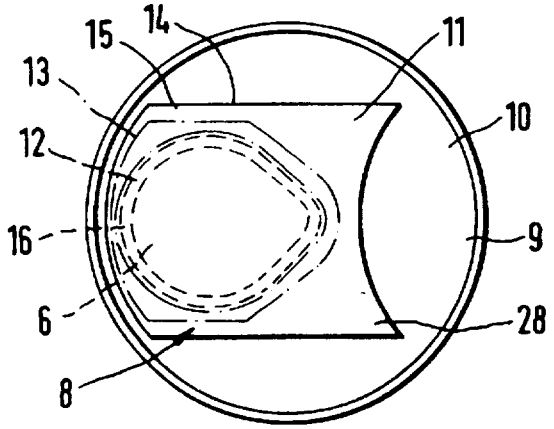
FIG. 2 is a top view of the container in FIG. 1.

The container 1 shown in FIGS. 1 and 2 comprises a cylindrical sleeve formed as container body part 2 and two front walls. The front walls close the front end openings of the container body part 2, whereby the one front wall is formed as a bottom 4 and the other front wall as a lid 3 of the container 1.

The lid 3 has an opening 6, which is used as a discharging opening as well as a filling opening. In a filled state, the opening 6 is sealed by a covering 7 which comprises a pull-tab 8 and a sealing seam 13. This sealing seam 13, shown in FIG. 2 by a dot-dash line, adheres the pull-tab 8 to the lid 3, whereby the pull-tab 8 rests on the outer surface 10 of the wall 9 of the lid 3. The interior 5 of the container 1 is made accessible by tearing off the pull-tab 8 from the wall 9.

As can be seen from FIG. 2, the opening 6 is provided with a protective covering 12, which extends along an edge 24 (see also FIG. 3*a*) and which, in cross section, has an approximately rivet-shaped form. The protective covering 12 extends in part over the area 11 of the wall 9 bordering the opening 6 (see also FIG. 2). The sealing seam 13 extends in a peripheral direction of the opening 6, but at a distance from the edge 24 of the opening 6 (see also FIGS. 2 and 3*d*).

A part area 15, which borders the periphery 14 of the pull-tab 8 in the direction of the opening 6 is excluded from the line of the sealing seam 13 (see also FIG. 2). A part area 16 which comprises the protective covering 12 is also excluded from the line of the sealing seam 13. The pull-tab 8 forms a grip 28 at one end which, when required, can be pulled from the wall 9 to open the opening 6.

As can be seen from FIGS. 3*a* to 3*d*, the pull-tab 8 is applied to the wall 9 in several procedural stages. That is, the wall 9 comprises a carrier layer 21 made of cardboard, as well as an inner protective layer 23 and an outer protective layer 22. The protective layers 22, 23 are plastic, whereby the protective layer 22 is made from a heat-sealable material, preferably polyethelene. The inner protective layer 23 forms the inner surface 20 while the outer protective layer 22 forms the outer surface 10 of the wall 9 of the container 1.

The pull-tab 8 consists of a metal foil, which is provided with a plastic layer on the side facing the interior 5 of the container 1. This plastic layer (not shown) serves to achieve in a known manner a heat-sealing connection with the outer surface 10 of the wall 9. Any other suitable material which possesses the properties required for a pull-tab 8 can be used, for example, a compound material with a layer of cardboard and one or more plastic layers.

Before filling, the pull-tab 8 is attached with a first section 26 to the outer surface 10 of the wall 9 by a dot-like sealing point 25 (see also FIG. 3*a*). A second, unattached section 27 of the pull-tab 8 takes up an upright position 27', so that the opening 6 is uncovered. The filling contents can be poured into the interior 5 of the container 1 through the opening 6 when the section 27 is in this upright position 27'. After the container 1 has been filled, the pull-tab 8 is placed over the opening 6 in a procedural stage shown in FIG. 3*b*. The second section 27 is hereby folded over into the position 27".

In a subsequent procedural stage shown in FIG. 3*c*, the pull-tab 8 is placed on the outer surface 10 of the wall 9 by pressing. Only a part of the entire length of the second section 27 is pressed against the outer surface 10 of the wall 9. A projecting section 29 of the pull-tab 8 remains. The second section 27 now takes up the position 27'''.

The pressing of the pull-tab 8 over the described area length is sufficient to enable the subsequent adhering of the pull-tab 8 to the wall 9. The pull-tab 8 is flattened out in the longitudinal area beginning with the first section 26. In particular, the folded edge between the first section 26 and the second section 27 is, to a large extent, straightened.

In a subsequent procedural stage shown in FIG. 3*d*, the pull-tab 8 is adhered to the outer protective layer 22 of the wall 9 by heat sealing. During the heat sealing operation, the sealing seam 13 is formed which, as mentioned above, extends along the periphery of the opening 6 at a distance thereto. The part areas 16 and 15 are, as mentioned above, excluded from the line of the sealing seam 13. Subsequently, a further procedural stage (not shown) follows, in which a further heat sealing and in particular, a flattening of the pull-tab 8 take place.

Figure 4:
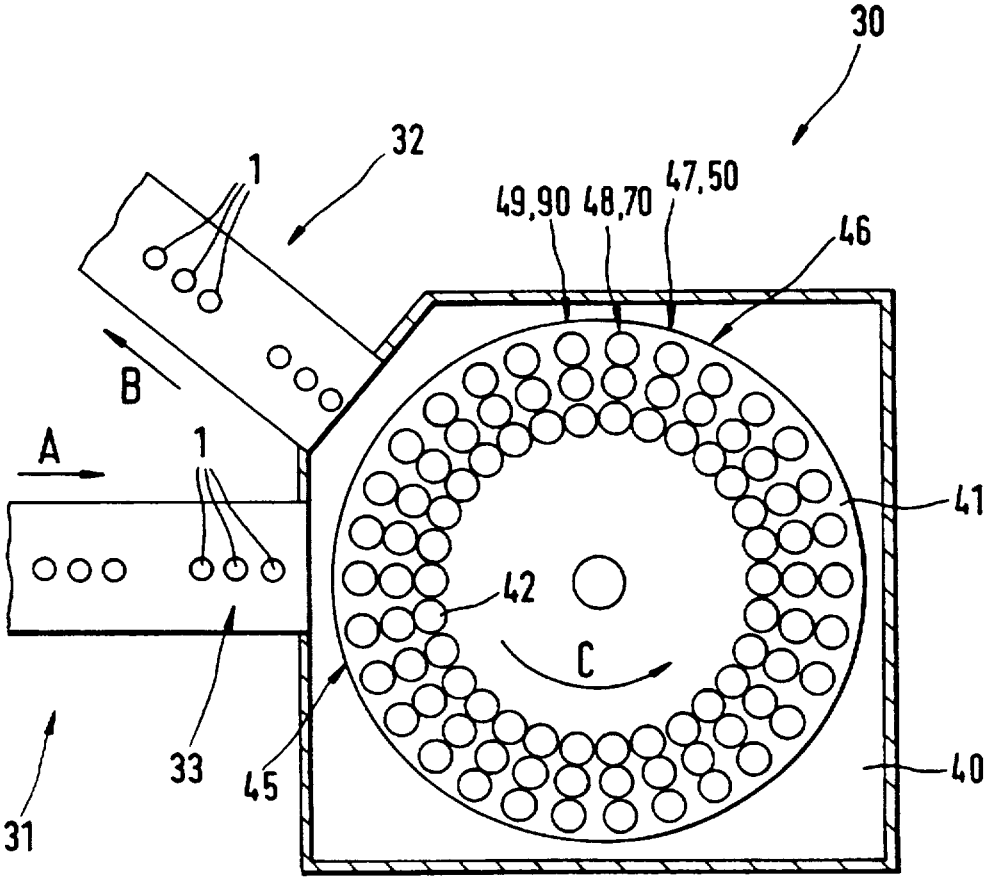
FIG. 4 is a schematic, partial cross-sectional view of a machine for filling and closing containers with application and adhering devices.

The machine 30 for filling and closing containers 1 shown in FIG. 4 comprises a housing with an aseptic chamber 40, in which various devices for applying pull-tabs 8 to containers 1 are contained. They include a device 50 for applying a pull-tab 8, a device 70 for adhering a pull-tab 8 to the wall 9 and a further adhering device 90 which serves also for flattening the pull-tab 8. The named devices 50, 70 and 90 are described below. Further known devices for sterilizing and filling are present in the aseptic chamber 40 but need not be described in any detail here.

The containers 1 to be filled are fed in the direction of arrow A by a transporting device 31 to the aseptic chamber 40. Before reaching the aseptic chamber 40, the containers 1 are transported to a device 33, at which a pull-tab 8 is attached over the above mentioned dot-like sealing point 25 on each container 1. The containers 1 are transported out of the aseptic chamber 40 by a transporting device 32 in the direction of arrow B after they have been filled and sealed closed. These latter processes will be described below.

A turntable 41 is arranged in the aseptic chamber 40, which turntable 41 is provided with take-up devices 42 for the containers 1, and which rotates in the direction of arrow C. The containers 1 reach a plurality of processing stations, at which the individual procedural stages for filling and closing the containers 1 are carried out. Only the processing stations 45 to 49 are shown in FIG. 4.

The containers 1, having passed through the device 33 described above, are fed in the direction of arrow A into the aseptic chamber 40 and transferred to the turntable 41. The containers 1 are hereby fed into the take-up devices 42 and secured there. Due to the rotating turntable 41, the containers 1 first reach the processing station 45, which comprises a device for setting up the pull-tab 8. At this processing station 45, the pull-tab 8 is set up such that the second section 27 takes up the position 27' shown in FIG. 3*a*.

As a result of the rotations made by the turntable 41, the containers 1 reach further known processing stations, which need not be described here, where they are sterilized and filled. After they have been filled, the containers 1 finally reach the processing station 46, which comprises a device for folding the pull-tab 8. This folding device essentially comprises a stationary rail (not shown), past which the containers 1 are guided while the turntable 41 is rotating. When the pull-tabs 8 pass the rail, they are laid against it and are thus folded over by the rail. The second section 27 attains thus the position 27" shown in FIG. 3*b*.

The above-mentioned device 50 which applies the pull-tab 8 is arranged at the following processing station 47. This device 50, which will be described in more detail below, presses the pull-tab 8 onto the wall 9, so that the second section 27 of the pull-tab 8 takes up the position 27"' shown in FIG. 3c. The above-mentioned device 70 which adheres the pull-tab 8 to the wall 9 by heat sealing is arranged at the sequentially following processing station 48. The second section 27 attains the position 27"" shown in FIG. 3d. The above-mentioned adhering device 90 which flattens the pull-tab 8 and heat seals it a second time is arranged at the sequentially following processing station 49.

The device 50 for applying the pull-tab 8 will be explained below with the aid of FIG. 5, where it is shown in three different positions 50', 50" and 50"'. The pull-tab 8 is applied by a spherical roller 52 whose peripheral surface 61 serves as an application surface. The roller 52 is arranged on the device 50 and will be described below. A swivelling lever 51 contains the roller 52, and a counter-holder 57 works in unison with the swivelling lever 51.

The swivelling lever 51 is supported, pivotable around a swivelling axle 54, with a longitudinal end in a holder 55 of the device 50. The spherical roller 52 is supported at the other longitudinal end of the swivelling lever 51, while being rotatable around an axle 53. The counter-holder 57 comprises a spring bolt 58 guided into the inside of a take-up cylinder 59. The spring bolt 58 is held constantly in position by a pressure spring 60, in which position the spring bolt 58 rests against the swivelling lever 51. The device 50 as a whole, including the swivelling lever 51 and the counter-holder 57, can be moved in the direction of arrow D. The spring bolt 58 can be moved against the force of the pressure spring 60 in the direction of arrow E. The swivelling lever 51 can be pivoted around the swivel axle 54 in the direction of arrow F.

Figure 5:
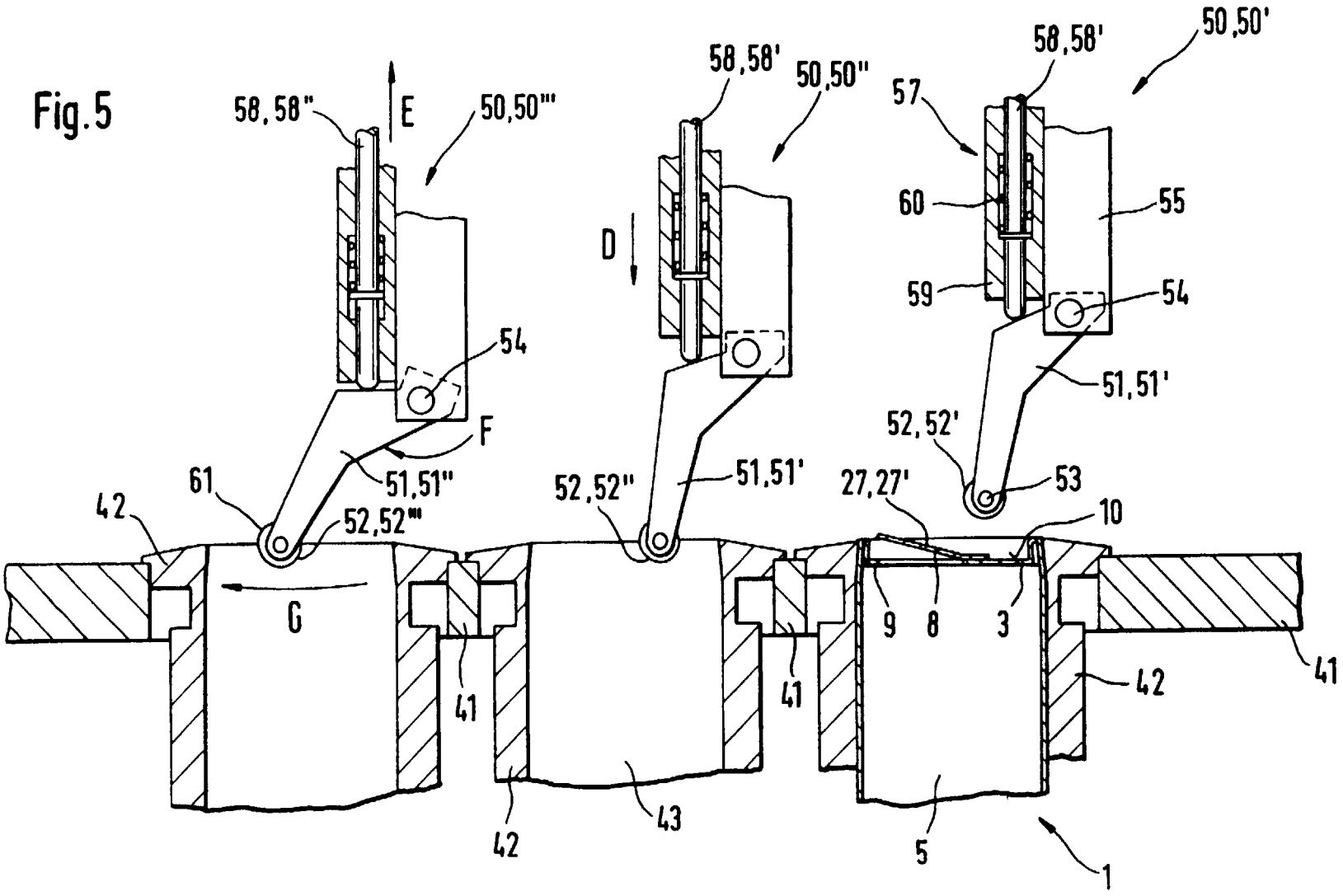
FIG. 5 is an elevational, partial cross-sectional schematic view of a device for applying a pull-tab over the opening of a container in three different operational positions.

The device 50 takes up the position 50' in the first processing stage shown in the right-hand section of FIG. 5. The pressure spring 60 holds the spring bolt 58 in the extended position 58', so that the swivelling lever 51 takes up the position 51'. Due to rotation of the turntable 41 during the first procedural stage, the device 50 is placed before a take-up device 42, which holds a container 1, without the device 50 itself being activated. The spherical roller 52 is in a position 52', somewhat above the take-up device 42 in which the container 1 is secured.

In the subsequent procedural stage, shown in the center section of FIG. 5, the device 50 is moved in the direction of arrow D into the position 50". The roller 52 hereby takes up a position 52" in which it rests against the outer surface 10 of the wall 9 of the lid 3. For reasons of clarity of illustration, the container 1 is also not shown in the center section of the diagram; only the empty interior 43 of the take-up device 42 is shown.

In the third procedural stage, shown in the left-hand section of FIG. 5, the device 50 is moved further in arrow direction D into the position 50"'. The roller 52 which rests against the outer surface 10 of the wall 9, or against the pull-tab 8, is rolled over the pull-tab 8 in the direction of the slightly curved arrow G. The swivelling lever 51 is thus pivoted in the direction of the arrow F into the position 51". As a result of the force from the spring bolt 58, the roller 52 is constantly pressed against the pull-tab 8 in the direction of the wall 9.

During the swivel movement of the swivelling lever 51 into the position 51", the spring bolt 58 is guided over into the position 58". The roller 52 takes up the position 52"', shown in the left-hand section of FIG. 5. This position 52"' lies shortly before the end position which the roller 52 takes up at the end of the movement of the swivelling lever 51. In the end position of the roller 52, the pull-tab 8 has attained the shape shown in FIG. 3c.

As a result of the pressure from the roller 52 on the wall 9, the wall 9 curves inwards towards the interior 5 of the container 1. This concave curvature of the wall 9 is compensated by the spherical form of the peripheral surface 61 of the roller 52 and by the slightly curved movement of the roller 52 in the direction of arrow G. The radius corresponds to the crowning of the surface line of the roller 52 which carries out a swivel movement along the slightly curved arrow G of FIG. 5. The continuous pressure of the spring bolt 58 on the swivelling lever 51 causes the roller 52 to automatically follow the curved movement of the wall 9 of the lid 3. Additionally, the spherical form of the roller 52 causes the adaptation to the concave curvature of the lid 3 due to the curved movement to be maintained.

Figure 6:
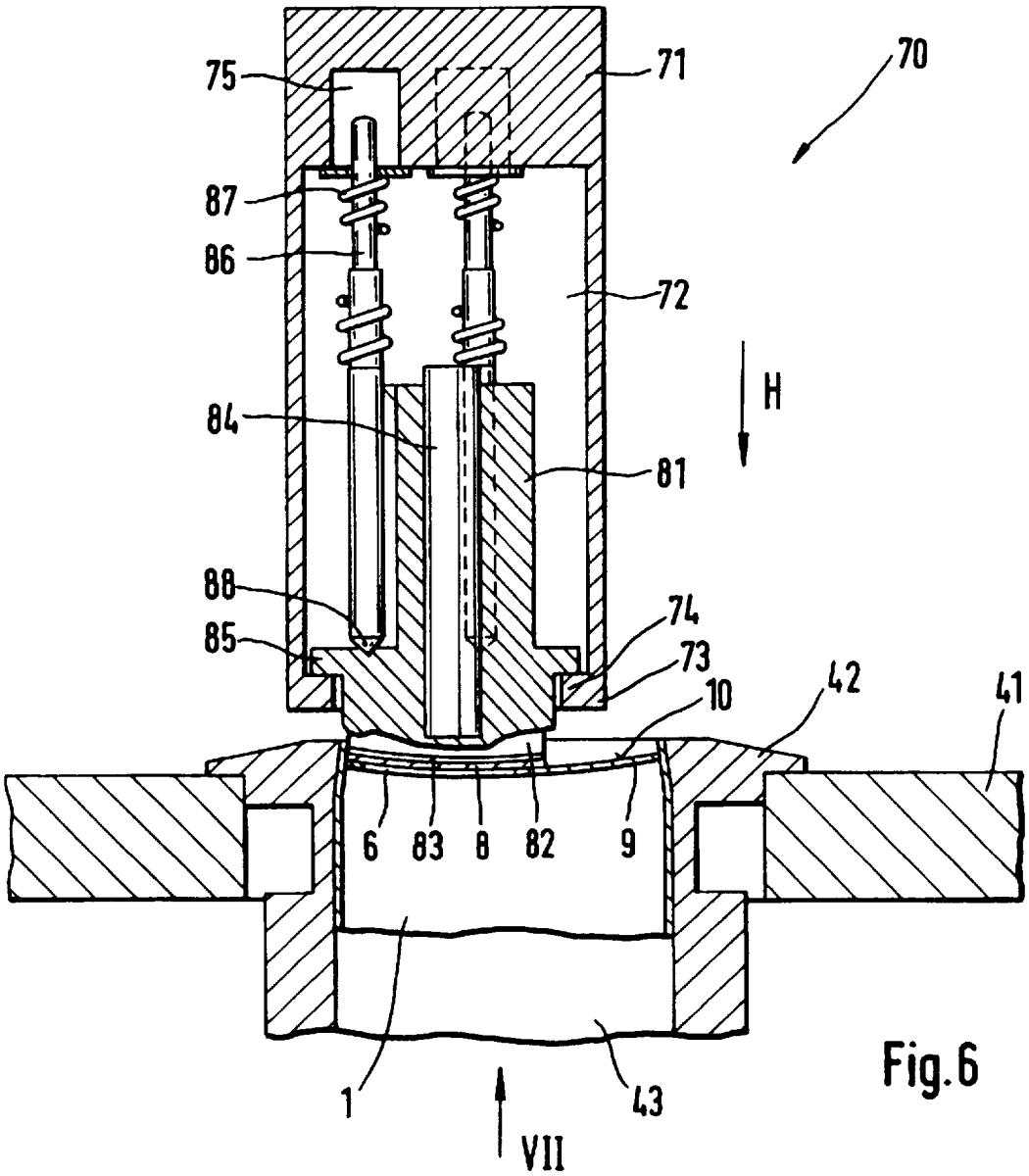
FIG. 6 is a partial cross-sectional view of a device for adhering a pull-tab to a container in longitudinal section.

The above-mentioned adhering device 70 is shown in more detail in FIG. 6. A take-up device 42 with a container 1 is placed before the device 70 by rotation of the turntable 41. The device 70 comprises a housing 71, in whose interior 72 a sealing punch 81 is movably arranged. A part of the front end 82 of the sealing punch 81 projects out of the opening which faces the take-up device 42 for the container 1.

The sealing punch 81 is provided with a collar 85, with which the sealing punch 81 is supported against a ring-shaped extending web 74 of the housing 71, with the web 74 projecting inwardly. Four outwardly projecting brackets are provided at the collar 85, which also serve as supports, and additionally, to prevent against rotating. When not in operation, the sealing punch 81 is held continuously in the above-mentioned position, resting against the projecting web 74, by way of three spring bolts 86 arranged in the peripheral direction.

The spring bolts 86 have conically-shaped tips on the ends facing the front end 82 of the sealing punch 81. The spring bolts 86 rest with their conically-shaped tips in hollow cone-shaped take-ups 88 which are arranged at the collar 85. The spring bolts 86 project with their other ends into take-ups 75 in the housing 71 and can be moved further into the take-ups 75 from the position shown in FIG. 6 against the force of a respective spring 87.

The sealing punch 81 is provided with a heating insert 84 with which the front end 82 of the sealing punch 81 can be heated to enable a heat sealing process. The front end 82 is provided with an application surface 83 which is curved convexly, preferably spherically, in all directions.

Figure 7:
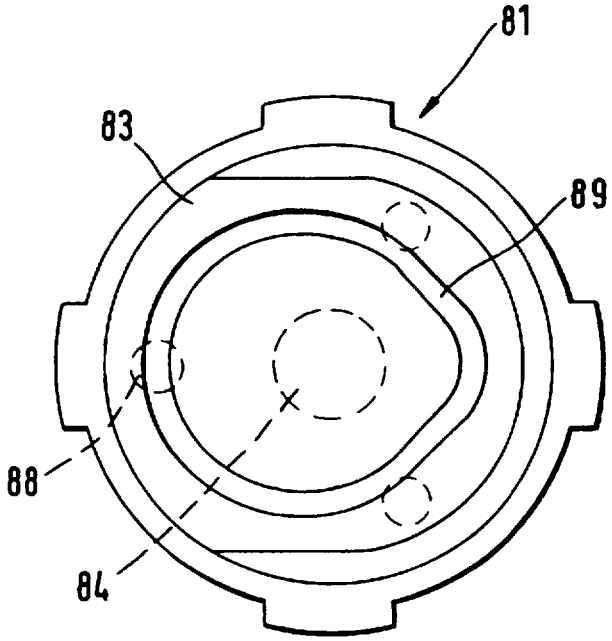
FIG. 7 is an enlarged view of the application surface of the application device shown in FIG. 6 in arrow direction VII thereof.

As can be seen from FIG. 7, the application surface 83 is provided with a groove-like recess 89 extending in the circumferential direction. The line of the recess 89 corresponds at least approximately to the line of the protective covering 12 (see also FIG. 2). The application surface 83 is, in relation to its outer measurements, somewhat smaller than the line of the periphery edge 14 of the pull-tab 8. The contour of the application surface 83 outside of the groove-like recess 89 corresponds at least approximately to the line of the sealing seam 13 made by the sealing punch 81. For the purpose of adhering the pull-tab 8 with the wall 9, the application surface 83 is brought to a heat sealing temperature via the regulatory heating insert 84. The device 70, including the sealing punch 81 is moved in arrow direction H and takes up the position shown in FIG. 6.

The sealing punch 81 comes to rest against the outer surface 10 of the wall 9 with its application surface 83 and curves the surface 10 inwardly in the direction of the interior 5 of the container 1. As a result of its sprung, non-rigid arrangement, effected by the spring bolts 86, the sealing punch 81 follows the curving wall 9 of the lid 3 through automatically. The sealing punch 81 thereby carries out oscillating or gyratory movements.

The pull-tab 8 fits to the convexly curved application surface 83. The convexly curved shape of the application surface 83 corresponds to the induced concave curve of the wall 9. The sealing punch 81 is thus adapted to the changing shape of the wall 9 by its sprung, non-rigid arrangement and also by its shape.

Due to the heat emanating from the application surface 83, the inner plastic layer of the pull-tab 8 melts with the outer protective layer 22 of the wall 9 (see also FIG. 3*a*), thus giving rise to a sealing seam 13. The sealing seam 13 takes a course which corresponds to the shape of the application surface 83 outside of the groove-like recess 89. The part area 15 and the part area 16 comprising the protective layer 12 (see also FIG. 3*d*) are excluded from the line of the sealing seam 13. As explained above with the aid of FIG. 4, the adhering device 90 is, in the series of production stages, downstream of the adhering device 70 and also serves to flatten out.

Figure 8:
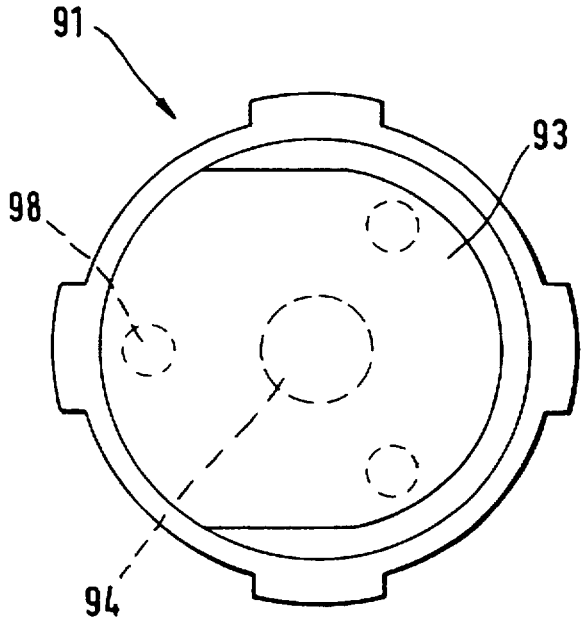
FIG. 8 is another embodiment of an application surface of an application device similar to that shown in FIG. 7.

The device 90 shown in FIG. 8 in a similar view to the device 70 as shown in FIG. 7, is also constructed identically to that same device 70. It comprises also a sealing punch 91 with a heating insert 94, and is taken up in a housing and supported by spring bolts which engage in hollow cone-shaped recesses 98. The essential difference between the device 70 and the device 90 is that the application surface 93 of the sealing punch 91 is not provided with a recess-like recess 89. The application surface 93 is, however, convexly curved in the same way and adapted to the form of the curving wall 9. The device 90 is used primarily for flattening and re-sealing the sealed pull-tab 8. The temperature of the application surface 93 can be regulated to suit different requirements.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An apparatus for assembling a pull-tab over an opening in a flexible container wall, comprising a device for applying the pull-tab to a surface of the wall over and around the opening, and a device for adhering the pull-tab to the surface of the wall, wherein the device for applying has an application surface arranged to be guidable in a direction following a curved shape of the flexible container wall, which curved shape occurs during the assembly operation, the application surface being curved and configured to be swivellable in a direction to permit the curved application surface thereof to move in a direction along the curved shape of the flexible container wall as the application surface presses the pull-tab against the flexible container wall around the opening.

* * * * *